US006180230B1

(12) United States Patent
Chaubet et al.

(10) Patent No.: US 6,180,230 B1
(45) Date of Patent: Jan. 30, 2001

(54) PERMANENTLY CRIMPED FIBRES AND METHOD FOR MAKING SAME

(75) Inventors: Olivier Chaubet, Lyons; Michel Cieslak, Basseux; Jean-Pierre Prevost, Berneville, all of (FR)

(73) Assignee: Novalis Fibres, Venissieux (FR)

( * ) Notice: Under 35 U.S.C. 154(b), the term of this patent shall be extended for 0 days.

(21) Appl. No.: 09/091,021

(22) PCT Filed: Dec. 5, 1996

(86) PCT No.: PCT/FR96/01944

§ 371 Date: Sep. 21, 1998

§ 102(e) Date: Sep. 21, 1998

(87) PCT Pub. No.: WO97/21858

PCT Pub. Date: Jun. 19, 1997

(30) Foreign Application Priority Data

Dec. 8, 1995 (FR) ..... 95 14738

(51) Int. Cl.[7] ..... D01F 6/00

(52) U.S. Cl. ..... 428/362; 428/369; 264/210.5; 264/210.8; 264/211.14

(58) Field of Search ..... 428/369, 362, 428/399, 377, 395; 264/103, 143, 210.5, 210.8, 211.14

(56) References Cited

U.S. PATENT DOCUMENTS

| | | | | |
|---|---|---|---|---|
| 3,341,914 | | 9/1967 | Van Blerk . | |
| 3,595,738 | * | 7/1971 | Clarke et al. | 428/362 |
| 4,343,860 | * | 8/1982 | Fernstorm | 428/362 |
| 5,281,476 | * | 1/1994 | Koyonagi et al. | 428/362 |
| 5,360,667 | | 11/1994 | Boles, Jr. et al. | 428/364 |
| 5,510,183 | * | 4/1996 | Travelute et al. | 428/377 |
| 5,547,726 | * | 8/1996 | Dingler | 428/362 |

FOREIGN PATENT DOCUMENTS

| | | |
|---|---|---|
| 0 028 844 | 5/1981 | (EP) . |
| 2 085 040 | 4/1982 | (GB) . |
| 109641 | 6/1983 | (JP) . |
| 239534 | 11/1985 | (JP) . |
| 184850 | 7/1994 | (JP) . |

* cited by examiner

*Primary Examiner*—Newton Edwards
(74) *Attorney, Agent, or Firm*—Burns, Doane, Swecker & Mathis, L.L.P.

(57) ABSTRACT

Permanently crimped fibres produced by three-dimensional texturing, and a method for making same, are disclosed. The fibres are advantageously produced by spinning and optionally stretching a filament roving. The roving is then fed to a three-dimensional texturing station then to a cutting device for cutting the roving into fibres having a predetermined length. The resulting fibres have high bulkiness and enable the production of non-woven surfaces having a remarkable abrasiveness as well as carpets with enhanced wear properties.

15 Claims, No Drawings

PERMANENTLY CRIMPED FIBRES AND METHOD FOR MAKING SAME

The invention relates to permanently crimped fibres obtained by three-dimensional texturing and to a process for manufacturing these fibres.

Fibres made of synthetic material are used in many applications for the manufacture of staple fibre yarns, of textile or covering surfaces, or as filling elements, for example. In the case of the manufacture of textile surfaces of the velvet type, as in the case of covering surfaces such as carpets, wall coverings, etc., the fibres are arranged and held in place on a support surface which may be a woven fabric, a knitted fabric, or a non-woven fabric, a surface made of synthetic or natural material which may or may not be reinforced with fillers.

Fibres are also used for the manufacture of non-woven or felt surfaces which have many applications, such as filtration, soil stabilization, abrasive surfaces, filling or insulating layers, stiffening material, interlining, reinforcing cloth, for example.

In these various applications, the fibres used are generally crimped fibres. Current processes for manufacturing fibres consist in manufacturing, by melt spinning, strands comprising a large number of filaments arranged in parallel. These strands are either collected in cans or are wound onto bobbins or other supports arranged, for example on a creel, in order to form a set of packages. These strands are advantageously assembled into a tow or a bundle which will be fed into a drawing/crimping apparatus.

In general, the drawing is carried out in a roll-type drawing unit, the crimping being obtained by overfeeding the tow onto a surface held in a heated box. The tow builds up on this surface and forms folds. The deformation of the filaments is set by the temperature in the box. Next, the tow is either fed into a chopper, in order to be cut into fibres of the desired length, or it is stored in the form of bales before fed into choppers.

The fibres thus obtained have a low bulk since the crimping is only carried out in one plane the fibre may be described as a zig-zag line.

Furthermore, this crimping process requires slow speeds and cannot therefore be carried out in line with the spinning, i.e. without a step of storing and reworking the tow between the spinning step and the crimping step, especially for high-linear density fibres or filaments.

The object of the invention is, in particular, to remedy these drawbacks by providing a fibre made of synthetic material which has a three-dimensional crimp structure, and therefore a greater bulk, and which can be obtained in an integrated process, without a step of storing and reworking the tow between the spinning step and the tow-chopping step.

The invention provides permanently crimped fibres made of synthetic material which are characterized by the fact that the crimp structures of the fibres lie in at least two intersecting planes.

This three-dimensional crimping makes it possible to obtain fibres which have a bulked appearance, and which, above all, maintain a high crimp content even under tension.

Thus, the fibres of the invention may advantageously have a crimp content of greater than 30% under a tension of 100 mg, of greater than 25% under a tension of 200 mg and even more advantageously a crimp content of greater than 20% under a tension of 400 mg.

By way of comparison, fibres having the same linear density, but with crimp structures lying only in one plane, have a crimp content of less than 30% as soon as a tension of 100 mg is applied.

Crimp content is determined by measuring the length ($L_d$) of a flattened fibre from which the crimp structures have been removed and the length ($L_f$) of the crimped fibre to which a defined tension is applied. The crimp content ($T_f$) is calculated using the formula:

$$\frac{(L_d - L_f)\times 100}{L_d} = T_f \ (\%)$$

According to another preferred characteristic of the invention, the crimp structures of the fibres of the invention are loops, or structures in which the fibre is folded back on itself in the form of a pigtail.

This crimping is obtained by a three-dimensional texturing of the filaments. This texturing is carried out, in one embodiment of the invention, by pneumatic packing of the multifilament tow, as will be described below.

According to another characteristic of the invention, the synthetic materials of which the fibres are composed are advantageously a polymer of the polyamide or copolyamide type.

By way of example of polyamides or copolyamides suitable for the invention, mention may be made of polyhexamethylene adipamide, polycaprolactam, copolymers of these two polyamides, or blends thereof. These polyamides may also contain other repeat units such as sulphonate aromatic units as the repeat unit derived from 5-sulphoisophthalic acid or the like, or units derived from other dicarboxylic acids, such as isophthalic or terephthalic acids, or diamines.

The polyamides may also be used with various additives, such as pigments, matting agents, heat or light stabilizers, heat-shielding agents, antimicrobial agents, antifouling agents or the like. This list is in no way exhaustive.

By way of preferred polyamide, mention may be made of polyhexamethylene adipamide and copolymers or blends comprising mostly hexamethylene adipamide units.

The fibres of the invention may have various linear densities. Thus, the fibres may have a linear density equal to a few dtex up to a linear density of several hundred dtex.

In a preferred embodiment of the invention, the fibres advantageously have a linear density of greater than 50 dtex, for example of between 50 and 250 dtex.

The fibres of the invention having, in particular, a high linear density, such as greater than 50 dtex, have feel and roughness properties which are completely unexpected and different from the crimped fibres obtained by mechanical packing.

The length of the fibres according to the invention may vary over wide ranges. However, according to a preferred characteristic of the invention, this length is advantageously between 25 mm and 200 mm.

Other characteristics of the fibres of the invention will appear in the examples given below by way of indication.

The subject of the invention is also a process for manufacturing the fibres described above.

This process consists in spinning a composition of synthetic material in one or more spinnerets at a temperature above the melting point of the said composition so as to obtain a certain number of filaments.

Next, these filaments are cooled using a coolant in order to lower their temperature to a value below or near the $T_g$ of the polymer. The filaments are then combined at a point, called the convergence point, in order to form a strand. The term "strand" should be understood to mean a combination of mutually parallel filaments.

The strand is optionally subjected to a drawing operation, and then fed into a three-dimensional texturing or pneumatic-packing-texturing step. Advantageously, this crimping is set in the texturing step. The strand thus crimped is advantageously fed into a chopping means in order to chop it into fibres of the desired length. Advantageously, several strands may be combined and fed jointly into the chopper.

These steps are preferably carried out without intermediate storage or reworking of the strand.

Thus, the process of the invention is, in the preferred embodiment of the invention, a continuous and integrated process which comprises, in line, the spinning, drawing, crimping, setting and chopping steps.

Depending on the linear density of the filaments, the spinning rate may vary from 500 m/min to 2500 m/min.

The spinning temperature is between 250° C. and 300° C. The filaments leaving the spinneret are cooled by a fluid which is advantageously either water or air.

Thus, for filaments having a linear density of greater than 50 dtex and preferably greater than 70 dtex, the coolant is advantageously water.

The filaments, after convergence into the form of a strand or bundle, are subjected to a drawing operation, the draw ratio advantageously being between 1 and 5, and preferably between 2 and 4.

This drawing is generally carried out between two or more sets of rolls, which may or may not be heated. It may be carried out cold or at a temperature which may be as high as 120° C.

The drawn filaments are fed into a crimping or texturing step operating according to the principle of pneumatic packing described, for instance, in French Patent No. 2,041,654. Thus, the filaments are entrained by a fluid heated to a temperature of greater than 100° C. in a nozzle, the filaments being taken up onto a drive roll downstream of the nozzle at a rate which is less than the rate at which the filaments enter the nozzle. The filaments are packed into the nozzle, thereby forming folds, the entraining fluid escaping laterally via holes provided in the wall of the nozzle.

The crimped strand is reeled out and then fed into chopping means in order to produce fibres of a defined length, for example advantageously between 25 and 200 mm.

The process of the invention makes it possible to obtain filaments and then fibres comprising three-dimensional crimp structures, but with the minimum of co-mingling between the filaments. Thus, on leaving the chopping means, the fibres can be easily separated and are compatible with being used, in particular, for the manufacture of non-wovens and staple fibre yarns or in flocking processes, for example.

Other applications of these fibres, in particular for fibres with a high linear density, for example greater than 70 dtex, are the production of non-woven surfaces for the manufacture of abrasive pads.

Further advantages and details of the invention will appear more clearly in the light of the examples, these being given below by way of illustration but implying no limitation.

A nylon-6,6 or PA 66 is extruded through a spinneret comprising 272 round holes 0.34 mm in diameter, the polymer output through the spinneret being 380 g/min. The filaments are cooled, by passing them through a bath of cold water, are driven by a delivery roll at a speed of 286 m/min.

They are then driven by a drawing roll at a speed of 720 m/min. The draw ratio of the filaments is 2.85.

The filaments combined in the form of a strand of 272 filaments are texturized according to U.S. Pat. No. 2,041,654. The accumulating fluid, composed of an air/steam mixture, has a temperature of 170° C.

The linear density of the strand is 5860 dtex.

The strand is fed into a chopper comprising 4 blades, in order to form fibres of 155 mm in length.

The fibres thus produced are analysed in order to determine their mechanical properties.

Fibres linear density: 21.6 dtex
tenacity: 23.5 cN/tex
% elongation at break: 87%
Young's modulus: 84 cN/tex.

Another test was carried out on the same polymer and using the same operating method, but with a spinneret having 32 round capillaries in order to obtain a filament linear density after drawing of approximately 200 dtex. The polymer output through the capillaries is 310 g/min. The draw ratio applied is 3, with a speed of 583 m/min. The fibres were chopped to a length of 60 mm.

The fibres have the following properties:

strand linear density: 197.5 dtex
tenacity: 23 cN/tex
% elongation at break: 60%
shrinkage in boiling water: 2.7%.

The crimp content under a tension of 200 mg is 42%.

Using a process identical to that used in the first two tests, PA 66 fibres having a linear density of 110 dtex were produced. The spinneret used comprises 56 capillaries. The polymer output through the capillaries is 420 g/min. The draw ratio is 2.9 with a draw speed of 770 m/min.

The 52 mm-long fibres have the following characteristics:

linear density: 109 dtex
tenacity: 25 cN/tex
% elongation at break: 52%
shrinkage in boiling water: 3.5%.

The crimp content under a tension of 200 mg is 24%. A carpet surface was produced using a staple yarn made from fibres obtained by spinning the fibres of Example 1 (approximately 22 dtex linear density). The staple fibre yarn manufactured using the standard spinning techniques has a metric count of 5/1 and is stored in the form of spools.

The carpet surface is manufactured according to the TUFT process, using, as backing or support, a non-woven surface sold under the brand name COLBACK® by the company AKZO. Two carpet surfaces (A and B) were obtained on a loom having a gauge of 1/10° and a number of stitches equal to 62/dm in the case of surface A and 48/dm in the case of surface B. The pile height, after shearing, is 6 nm in the case of both surfaces.

Surface A has a density of 700 g/m$^2$ while that of surface B is 540 g/m$^2$.

The wear properties of these surfaces were determined by tests called VETTERMANN tests (reference ISO/TR 10361 of Nov. 15, 1990) and the rolling-chair or castor-chair test (reference ISO TR 4918 of Oct. 15, 1990).

The VETTERMANN test consists in placing carpet-surface specimens on the inside of a drum which contains a round steel ball having rubber studs on its surface. The drum is rotated, making the steel ball move so as to come into contact with the surface of the specimens. After 22,000 cycles of the drum, the surface appearance of the specimens is assessed according to the ISO/TR 9405 standard. Surface A has a rating equal to 3.7, while surface B has a rating of 3.5. The rolling-chair or castor-chair test consists in making one or more castors under a load of 90 kg move over the surface of a carpet specimen. The surface appearance of the specimens and their loss of thickness are determined according to the ISO TR 4918 and ISO TR 9405 standards. The results obtained are given in the table below:

| | Surface appearance | | Final | Loss of thickness (%) | |
|---|---|---|---|---|---|
| Carpet | After 5000 cycles $I_{5000}$ | after 25,000 cycles $I_{5000}$ | rating $I_R = 0.75\ I_{5000} + 0.25\ I_{25000}$ | After 5000 cycles | after 25,000 cycles |
| A | 3.5 | 2.2 | 3.18 | 30 | 44 |
| B | 3 | 2.3 | 2.83 | 41 | 49 |

These results are superior to those obtained on a carpet manufactured using the same technique, but with a staple fibre yarn spun using fibres crimped by mechanical packing (two-dimensional crimping).

Tests on the manufacturability of carpets using the technique of needle-punched surfaces also demonstrate the good aptitude of the fibres according to the invention for this application.

The same applies to the production of scouring pads.

What is claimed is:

1. Permanently crimped fibres made of polyamide or copolyamide, wherein the crimp structure of the fibres is three-dimensional, and the linear density of the fibres is greater than 50 dtex.

2. Fibres according to claim 1, wherein the fibres have a crimp content which is greater than 30% under a tension of 100 mg.

3. Fibres according to claim 1, wherein the fibres have a crimp content which is greater than 25% under a tension of 200 mg.

4. Fibres according to claim 1, wherein the fibres have a crimp content which is greater than 20% under a tension of 400 mg.

5. Fibres according to claim 1, wherein the crimping is obtained by a three-dimensional texturing.

6. Fibres according to claim 1, wherein the polyamide or copolyamide is chosen from PA 6, PA 66, a PA 66/6 copolymer, a PA 66/PA 6 blend, or PA 66 or PA 6 containing sulphonate aromatic units.

7. Fibres according to claim 1, wherein said fibres have a length of between 25 mm and 200 mm.

8. Fibres according to claim 1, wherein said fibres have loops or folded-back structures in the form of a pigtail.

9. Process for manufacturing the fibres according to claim 1, comprising:

spinning a composition of polomide or copoymide at a temperature above the melting point of the said composition;

cooling the filaments obtained using a coolant;

making the filaments converge in order to form a strand;

optionally, drawing the filaments;

subjecting the filaments strand form to three-dimensional texturing;

setting the texturing by a heat treatment; and feeding the strand into a chopping device in order to chop the filaments into fibres.

10. Process according to claim 9, wherein the three-dimensional texturing is carried out by pneumatic packing of the strand in a nozzle.

11. Process according to claim 10, wherein the fluid used for the pneumatic packing is air, steam or an air/steam mixture.

12. Process according to claim 9, wherein the temperature of the pneumatic-packing fluid is greater than 100° C.

13. Process according to one of claim 9, wherein characterized in that the fluid for cooling the filaments beneath the spinnerets is air or water.

14. Process according to claim 13, wherein the fluid for cooling the filaments is water and the pneumatic-packing fluid is a steam/air mixture.

15. Fibres according to claim 1, wherein the density is between 50 dtex and 250 dtex.

* * * * *